United States Patent [19]

Lofberg

[11] 3,973,609

[45] Aug. 10, 1976

[54] CONTAINER FOR MINIMIZING STRESSES

[75] Inventor: Gustaf Gerhard Lofberg, Landskrona, Sweden

[73] Assignee: Supra Aktiebolag, Landskrona, Sweden

[22] Filed: Apr. 29, 1975

[21] Appl. No.: 572,823

[30] Foreign Application Priority Data

May 3, 1974 Sweden ..... 7405935

[52] U.S. Cl. ..... 150/1

[51] Int. Cl.[2] ..... B65D 33/14

[58] Field of Search ..... 150/.5, 1, 8, 12; 229/54 C; 222/105

[56] References Cited

UNITED STATES PATENTS

| | | | |
|---|---|---|---|
| 1,335,607 | 3/1920 | Salisbury | 150/1 |
| 1,996,619 | 4/1935 | Katz | 229/54 C |
| 2,612,924 | 10/1952 | Cunningham | 150/1 |
| 3,028,897 | 4/1962 | Gooding | 150/1 |
| 3,044,515 | 7/1962 | Eades | 150/1 |
| 3,851,688 | 12/1974 | Winter | 150/8 |

*Primary Examiner*—Donald F. Norton
*Attorney, Agent, or Firm*—Fleit & Jacobson

[57] ABSTRACT

The invention comprises a container having a casing with an upper portion and a bottom. An elongate member has one end thereof anchored to said upper portion and in the other end anchored to said bottom. The elongate member passes slidingly between said ends through an opening in said upper portion, while forming a loop externally of the casing between the anchoring point on said upper portion and said opening. The loop being adapted to receive therein a container-lifting device.

9 Claims, 7 Drawing Figures

CONTAINER FOR MINIMIZING STRESSES

BACKGROUND AND SUMMARY OF THE INVENTION

The present invention relates to a container of the type which comprises a casing with an upper portion and a bottom, and an elongate flexible member which has one end thereof anchored to said upper portion and the other to said bottom and which passes through the container space. The invention is primarily intended for use with such containers which, when empty, are unable to readily retain their shape, for example large sacks, which when full are too heavy to be lifted manually, such sacks together with the contents weighing, for example, several hundred kilograms. The invention is not restricted to containers which have poor shape-stability, however, but can also be advantageously applied to containers of fairly rigid construction, such as relatively large box-like containers.

A disadvantage with previously known containers of the type described above is that, when said container with its contents is lifted, the container is subjected to local stresses and strains in the region where the flexible elongate member is connected to the container. To avoid rupturing the container casing, the casing as a whole must have considerable strength or must be reinforced at the elongate member attachment points, thereby adding to the cost of the container. Such additional costs are particularly difficult to bear when the container is intended for use as a disposable container for goods, having a relatively low kiloprice, such as pulvurent or granulated artificial manure.

The primary object of the invention is to provide a novel, inexpensive and useful container with which the aforementioned disadvantage is substantially eliminated.

To this end, it is proposed in accordance with the invention that there is provided a container of the type previously described, wherein the elongate member extends longitudinally displaceably through an opening in said upper portion and is arranged to form a loop between said opening and the anchoring point on said upper portion for receiving a container-lifting device. Such an arrangement causes the load exerted on the container casing, when the container with its contents is lifted, to be automatically distributed thereby enabling the container to be manufactured from a relatively weak and inexpensive material whilst ensuring that the container is relatively rupture-proof. However, should the casing rupture at one of the elongate member anchoring points, there is no appreciable risk of the container and its contents falling as a unit, with the risk of causing serious injury to persons beneath the container or other serious damage as a result thereof. Instead, in the event of rupture at the bottom of the container, the container contents will run rapidly, although successively, from the container without risk of causing serious injury or damage. In the event of rupture at the upper portion of the container, the container, which is supported at the bottom thereof by means of the lower end of the elongate member, is turned inside out, whereupon the contents of the container successively run out subsequent to a certain degree of downward movement on the part of the container.

BRIEF DESCRIPTION OF THE DRAWINGS

Corresponding or substantially corresponding elements are identified in the different figures of the drawings with the same reference numerals.

DETAILED DESCRIPTION OF THE INVENTION

Figure 1:
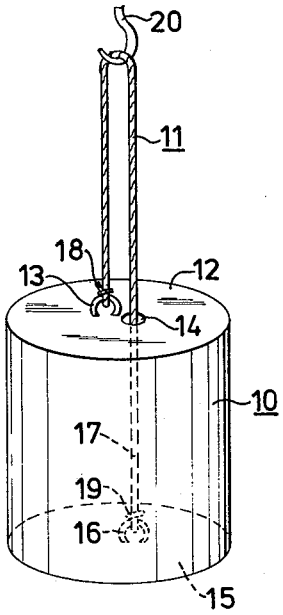
FIG. 1 is a perspective view of a substantially shape-stable container in accordance with the invention.

The container shown in FIG. 1 comprises a casing 10 and an elongate member shown generally at 11. As seen in the drawing, the casing 10 has an upper portion 12 substantially centrally on which there is arranged an external attachment means 13 and a through opening 14. The bottom 15 of the casing is provided internally with an attachment means 16.

One end of the elongate member 11, which e.g. may have the form of a rope (as shown) or a chain, is connected to the external attachment means 13 and the other end of said member is connected to the internal attachment means 16, the rope passing slidingly through the opening 14 and a portion 17 of the rope extending freely through the container space. The attachment means are shown to comprise anchoring rings to which the ends of the rope are connected by means of knots 18 and 19.

The container is adapted to be lifted by means of a lifting hook 20 or the like, which is caused to engage a loop or bight in the rope as shown and which will permit sliding of said rope, such that the stresses and strains to which the rope is subjected, when the container and its contents are lifted, are distributed to both portions of the rope loop, said stresses and strains being transferred to and substantially uniformly distributed between the upper portion 12 and the bottom 15 of the container. The portion 17 of the rope extending through the container space thus forms a load distributing means which transfers to the bottom 15 of the container part of the total load acting on the rope when the container and its content are lifted thereby.

Figure 2:
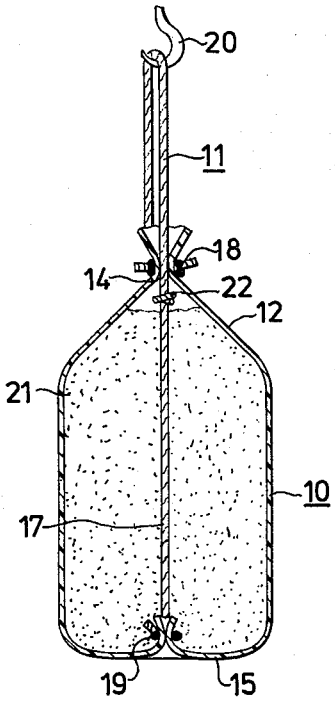
FIG. 2 is an axial section view of a second container having substantially the same construction as the container shown in FIG. 1, but being provided with a casing which can not readily retain its shape when the container is empty.

With the embodiment illustrated in FIG. 2, the container casing 10 comprises a disposable sack made from a flexible and optionally to some extent stretchable material, said material comprising e.g. thin plastics material, plastics coated paper or fabric material formed to the shape of a tube, from which said sack being formed by gathering and securing together the two ends of the tube with the illustrated embodiment. The open ends of the tube are held together by means of the rope or the like forming the elongate member 11. Subsequent to tying the first knot 19, the tube is turned inside out so as to form a sack which is open at the top thereof with a rope extending through the interior of the sack and out through said sack opening. Subsequent to filling the sack with the material shown at 21, a knot 18 is tied with the free end of said rope in a manner such as to close the upper opening of said sack, the upper end of the tube being passed around the portion of the rope passing through the upper sack opening, to form a sack upper portion 12 having a small opening 14 through which the rope can slide. The knots 18 and 19 anchor the ends of the rope to the upper sack portion 12 and the bottom 15 of said sack. It will be understood that when lifting the sack shown in FIG. 2 by means of a hook 20 or the like, the stresses and strains to which the casing is subjected will be distributed between the upper sack portion 12 and the bottom 15 substantially in the manner described with reference to FIG. 1.

The reference 22 indicates a stop means which is arranged to restrict movement of the rope axially outwardly through the opening 14, by engagement with the inside of the upper sack portion 12. When emptying the sack, which is suitably effected by cutting the bottom 15, the stop 22 prevents the upper sack portion 12 from sliding an excessive distance down along the rope portion 17, such sliding of the upper sack portion 12 otherwise causing unfavourable deformation of the container casing from a container-emptying point of view.

Figure 3:
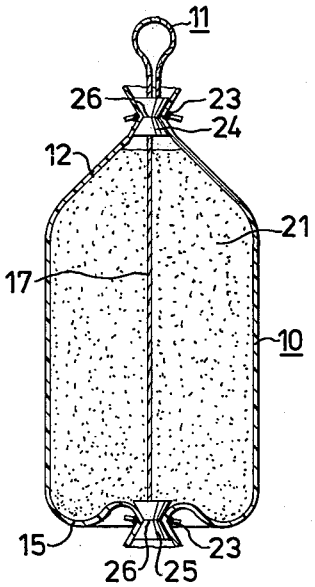
FIG. 3 is an axial sectional view of a third container according to the invention.

FIG. 3 shows a container in the form of a sack formed from a tubular blank substantially in the manner described with reference to FIG. 2. With the embodiment of FIG. 3, however, the ends of the tubular blank are held together at the top and bottom thereof by means of a separate rope 23. The two ends of the elongate member 11, which is shown to comprise a rope or the like, are anchored to the casing 10 via intermediate members 24, 25, that portion of the rope situated between said ends passing slidably through a hole in the upper intermediate member 24, as will be described more clearly herebelow with reference to FIGS. 6 and 7. The intermediate members are provided with peripheral grooves 26 and the casing is held gathered around said intermediate members in said grooves by means of ropes 23. The rope 23 is conveniently knotted around the casing 10 and the intermediate member 25 by means of a really releasable knot. This enables the container to be emptied by releasing the knot, thereby preventing damage to the casing 10 when the container is emptied. When the container shown in FIG. 3 is lifted by means of the rope loop intended therefor the load is distributed between the upper portion 12 of the casing 10 and the bottom 15 in the manner described above with reference to FIGS. 1 and 2.

Figure 4:
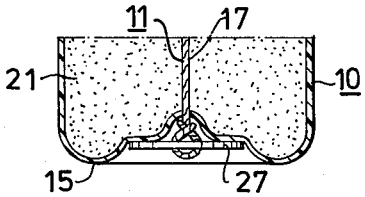
FIGS. 4 and 5 are axial sectional views showing two alternative methods of anchoring the elongate member to the bottom of the container.

In FIG. 4 there is shown an alternative method of anchoring the elongate member 11 to the container bottom 15. The lower end of the member 11, which is shown to comprise a rope or the like, is anchored to a plate 27 arranged externally of the container bottom 15, said member 11 extending into the interior of the container through a small hole in said bottom.

Figure 5:
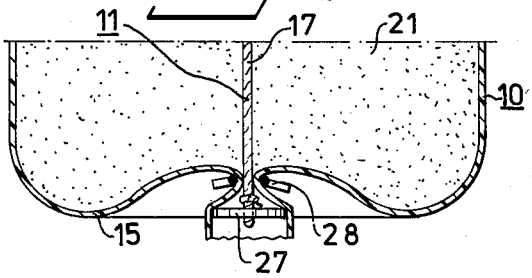

FIG. 5 shows another method of anchoring the elongate member 11 to the container bottom 15. The container comprises in this case a sack formed from a tubular blank of flexible material. The elongate member 11 has at its lower end a thickened portion 27 and is anchored to the container bottom 15 by holding the container casing gathered together around the member 11 immediately above the portion 27. Although with the illustrated embodiment the portion 27 is shown to comprise a small plate said portion, when the elongate member 11 comprises, for example, a rope, may also comprise a knot located at the lower end of the elongate member 11. The container casing can be held together in the shown manner above the portion 27 by means of a readily released arrangement. This arrangement is shown to comprise a separate rope 28 which by means of a readily released knot is tied around the container casing and the elongate member 11. In this latter case the container is emptied simply by releasing the knot. In this way the container 10 is not damaged when emptying the same and can be re-used.

For safety reasons it is expedient, for example, to duplicate the elongate member 11 and to adapt each member to be individually capable of withstanding the weight of the container and its contents.

Figure 6:
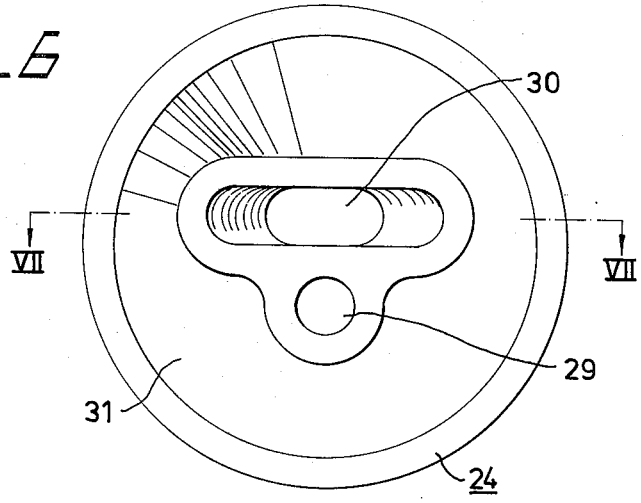
FIG. 6 is a view from below of an intermediate member for use with the container shown in FIG. 3.
Figure 7:
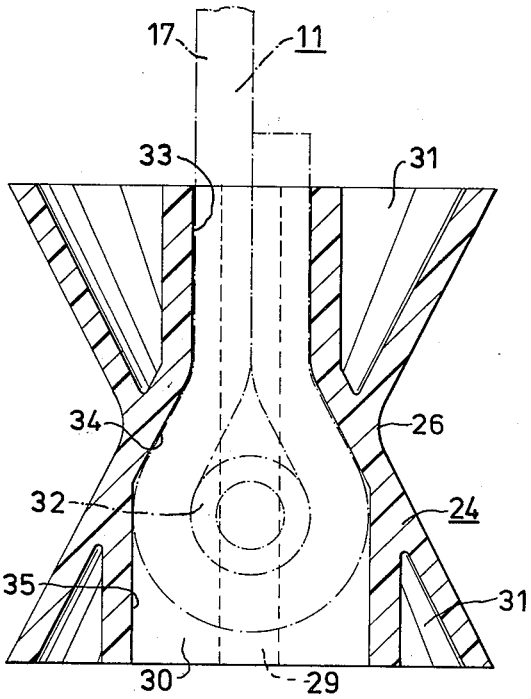
FIG. 7 is a sectional view taken through the VII — VII in FIG. 6.

The intermediate member 24 shown in FIGS. 6 and 7 comprises a substantially hour-glass-shaped rigid body which is throughpassed axially by two holes 29 and 30. To save material, the body, as is shown, may be provided with recesses 31. The hole 29 has a circular cross section and is so dimensioned as to enable the elongate member 11 to slide substantially freely therethrough. The other hole 30, together with an insert 32, forms a wedging device for releasably securing an end portion of the elongate member 11. With the illustrated embodiment, the hole 30 has an upper portion 33 whose cross-sectional area and shape is such as to substantially correspond to the cross-sectional shape of two adjacently situated portions of the elongate member 11, and a lower portion 35 whose cross-sectional area and shape is such that it substantially corresponds to the total cross-sectional area of the insert 32 and two portions of the elongate member 11 located on respective sides of the insert, and a portion 34 which tapers from the portion 35 to said portion 33. The end portion of the member 11 is secured in the intermediate member 24 by placing said member around the insert 32 and inserting said member into the hole 30 in the manner shown in FIG. 7 with dash-dot lines. It will be understood that the wedging effect obtained in between, on one side the defining wall of the portion 34, and on the other side the insert 32 and the portions of the elongate member 11 passing therearound will increase when tension forces are applied to the portion of the elongate member referenced 17 in the figure. The lower intermediate member 25 shown in FIG. 3 may also, in principle, be constructed in the manner shown in FIGS. 6 and 7. In this instance, however, the hole 29 should be omitted or blocked. It will be understood, however, that other locking arrangements may be provided for securing the ends of the elongate member 11.

The invention is not restricted to the illustrated embodiments described above, but can be modified within the scope of the following claims.

I claim:

1. A container comprising a casing with an upper portion and a bottom defining a container space, and an elongate flexible member which has one end thereof anchored at a first anchoring point to said upper portion and the other end portion anchored at a second anchoring point to said bottom and which passes through the container space, wherein the elongate member extends longitudinally displaceably through an opening in said upper portion and is arranged to form a loop between said opening and said first anchoring point on said upper portion for receiving a container-lifting device.

2. A container as claimed in claim 1, wherein the casing comprises a flexible material.

3. A container as claimed in claim 2, wherein the casing comprises a stretchable material.

4. A container as claimed in claim 1, wherein said casing comprises a sack, and wherein said opening has been formed by holding the sack portion defining the sack opening gathered together around said elongate member.

5. A container as claimed in claim 1 wherein said container comprises a sack formed from a tubular flexible blank, and wherein said other end of said elongate member is provided with an enlarged member and is anchored at said bottom by holding said casing gathered around said elongate member immediately above said enlarged member.

6. A container as claimed in claim 1, wherein at least one end of the elongate member is secured to the casing via an intermediate member which in turn is releasably connected to the casing.

7. A container as claimed in claim 6, wherein the intermediate member exhibits a peripheral groove and wherein the casing is held gathered around the intermediate member in said groove.

8. A container as claimed in claim 6, wherein the intermediate member has a through opening which forms said opening in the upper portion of said casing and which permits the elongate member to slide therethrough.

9. A container as claimed in claim 6, wherein the intermediate member exhibits a wedging, locking means for releasably securing an end portion of the elongate member.

* * * * *